US011125511B2

(12) United States Patent
Thomas et al.

(10) Patent No.: US 11,125,511 B2
(45) Date of Patent: Sep. 21, 2021

(54) MATRIX FOR AN AIR/OIL HEAT EXCHANGER OF A JET ENGINE

(71) Applicant: SAFRAN AERO BOOSTERS SA, Herstal (BE)

(72) Inventors: Vincent Thomas, Hognoul (BE); Bruno Servais, Braives (BE); Roel Vleugels, Geel (BE)

(73) Assignee: SAFRAN AERO BOOSTERS SA, Herstal (BE)

( * ) Notice: Subject to any disclaimer, the term of this patent is extended or adjusted under 35 U.S.C. 154(b) by 130 days.

(21) Appl. No.: 16/314,009

(22) PCT Filed: Sep. 29, 2017

(86) PCT No.: PCT/EP2017/074744
§ 371 (c)(1),
(2) Date: Dec. 28, 2018

(87) PCT Pub. No.: WO2018/065304
PCT Pub. Date: Apr. 12, 2018

(65) Prior Publication Data

US 2019/0170450 A1 Jun. 6, 2019

(30) Foreign Application Priority Data

Oct. 3, 2016 (BE) ..... 2016/5734

(51) Int. Cl.
*F28F 1/10* (2006.01)
*F28F 1/12* (2006.01)
(Continued)

(52) U.S. Cl.
CPC ..... *F28F 1/126* (2013.01); *F01D 25/12* (2013.01); *F28D 7/16* (2013.01); *F28D 7/1638* (2013.01);
(Continued)

(58) Field of Classification Search
CPC ..... F28F 1/126; F28F 1/34; F28F 1/38; F28F 1/26; F28F 2250/10; F28F 2215/00;
(Continued)

(56) References Cited

U.S. PATENT DOCUMENTS 1,602,811 A * 10/1926 Clingaman ..... F28F 1/126 165/151
1,990,541 A 2/1935 Fugle
(Continued)

FOREIGN PATENT DOCUMENTS

JP S49854 A 1/1974

OTHER PUBLICATIONS

International Search Report dated Nov. 30, 2017 for Parent PCT Appl. No. PCT/EP2017/074744.

*Primary Examiner* — Travis C Ruby
(74) *Attorney, Agent, or Firm* — James E. Walton

(57) ABSTRACT

Matrix (30) for a heat exchanger to exchange heat between a first fluid and a second fluid, the first fluid being for instance air and the second fluid being for instance oil. The matrix (30) comprises: a channel for the first fluid. an array of passages for the second fluid, the passages extending in the channel. The array supports at least two cooling fins. The matrix is made by a process of additive manufacturing. The fins are inclined with respect to each other along the direction of the flow of the first fluid.

4 Claims, 6 Drawing Sheets

(51) Int. Cl.

| | |
|---|---|
| ***F28F 1/38*** | (2006.01) |
| ***F28F 1/34*** | (2006.01) |
| ***F28D 7/16*** | (2006.01) |
| ***F01D 25/12*** | (2006.01) |

(52) U.S. Cl.
CPC ..... *F28F 1/34* (2013.01); *F28F 1/38* (2013.01); *F05D 2260/22141* (2013.01); *F28F 2250/10* (2013.01)

(58) Field of Classification Search
CPC ..... F28F 2215/04; F01D 25/12; F28D 7/16; F28D 7/1638; F28D 7/1653; F05D 2260/22141
See application file for complete search history.

(56) References Cited

U.S. PATENT DOCUMENTS 2,021,117 A * 11/1935 Lucke ..... F28F 1/36 165/157
3,045,979 A * 7/1962 Huggins ..... F28F 1/126 165/152
4,771,825 A * 9/1988 Chen ..... F28F 1/30 165/151
5,193,611 A * 3/1993 Hesselgreaves ..... F28F 3/02 165/165
7,147,047 B2 * 12/2006 Wolk ..... F28D 1/05383 165/152
8,069,905 B2 * 12/2011 Goto ..... F28D 7/1615 165/41
2010/0307729 A1 * 12/2010 Sarkisian ..... F22B 37/06 165/183
2014/0027102 A1 * 1/2014 Antel, Jr. ..... F28F 13/003 165/185
2014/0318753 A1 * 10/2014 Greiner ..... F28F 13/12 165/166
2015/0345396 A1 12/2015 Zelesky et al.
2015/0361922 A1 * 12/2015 Alvarez ..... F28D 9/0081 165/185
2016/0069623 A1 * 3/2016 Iwasaki ..... F28D 21/0003 165/109.1
2016/0230595 A1 * 8/2016 Wong ..... F01D 25/12
2016/0265850 A1 * 9/2016 Kupiszewski ..... F01D 25/12
2016/0290729 A1 * 10/2016 Lee ..... F22B 37/101

* cited by examiner

MATRIX FOR AN AIR/OIL HEAT EXCHANGER OF A JET ENGINE

TECHNICAL FIELD

The invention relates to the field of turbomachine heat exchangers. More specifically, the invention provides a matrix for an air/oil heat exchanger. The invention also relates to an axial turbomachine, in particular an aircraft turbojet engine or an aircraft turboprop engine. The invention further provides a method of making a heat exchanger matrix. The invention also relates to an aircraft provided with a heat exchanger matrix.

PRIOR ART

The document US 2015/0345396 A1 discloses a turbojet engine with a heat exchanger. This heat exchanger equips a blade wall in order to cool it. The heat exchanger has a body in which a vascular structure is formed for passing a cooling fluid through the body. The vascular structure is in the form of nodes connected by branches, these nodes and branches being recessed so as to provide interconnected passages through the body. However, the efficiency of heat exchange remains limited.

SUMMARY OF THE INVENTION

Technical Problem

The object of the invention is to solve at least one of the problems posed by the prior art. The object of the invention is to optimize the heat exchange, the losses of charges, and possibly the operation of a turbomachine. The invention also aims to provide a simple solution, resistant, lightweight, economical, reliable, easy to produce, convenient maintenance, easy inspection, and improving performance.

Solution

The subject of the invention is a heat exchanger matrix between a first fluid and a second fluid, in particular a heat exchanger matrix for a turbomachine, the matrix comprising: a channel for the flow of the first fluid; an array extending in the channel and in which the second fluid flows; remarkable in that the array supports at least two fins successive along the flow of the first fluid, such as cooling fins; said successive fins extending in the main direction of flow of the first fluid inclined relative to each other.

According to particular embodiments, the matrix may comprise one or more of the following features, taken separately or according to all the possible combinations:

- The successive fins are inclined relative to each other by at least 10°, or at least 45°.
- The first fluid flows through the matrix in a main direction of flow; between the two successive fins the matrix comprises a passage oriented transversely with respect to said main direction.
- The successive fins form successive crosses along to the flow of the first fluid, said successive crosses being optionally rotated relative to each other.
- The matrix comprises several sets of successive fins arranged in several successive planes following the flow of the first fluid, said planes being optionally parallel.

- The successive fins extend from an area of the array, in projection against a plane perpendicular to the flow of the first fluid, the successive fins cross each other away from said array area.
- The successive fins are contiguous or spaced apart from each other in the direction of flow of the first fluid.
- The array comprises a plurality of tubes, possibly parallel.
- The profile of the tubes is an ellipse, a teardrop, or a rhombus.
- The array comprises walls separating the first fluid from the second fluid, the successive fins extending from said wall,
- The array comprises a mesh.
- The mesh is profiled according to the flow direction of the first fluid.
- The mesh defines corridors for the flow of the first fluid, the corridors possibly being of quadrangular section.
- The matrix is adapted for a heat exchange between a liquid and a gas, in particular a gas stream passing through a turbojet engine.
- The successive fins comprise main sections in which the main directions are arranged, the main directions of the main sections being inclined relative to each other.
- The main directions are inclined relative to each other by at least 5°, or at least 20°, or 90°.
- The successive fins comprise junctions on the array which are offset transversely with respect to the flow of the first fluid.
- The tubes describe at least one alignment or at least two alignments, in particular transversely with respect to the flow of the first fluid.
- The two successive fins connect adjacent tubes, possibly crossing in the gap between said tubes.
- Each fin is full, and/or forms a flat wafer.
- Each fin comprises two opposite ends which are joined to the array.
- The thickness of the successive fins is between 0.10 mm and 0.50 mm; or between 0.30 mm and 0.40 mm; and or less than the thickness of the partition.
- The successive fins describe at least one intersection, preferably several intersections.
- The intersections are spaced from each other, or have a continuity of material, according to the flow of the first fluid.
- The tubes are spaced according to the flow of the first fluid and/or transversely to the flow of the first fluid.
- The mesh extends over the entire length and/or the entire width and/or the height of the matrix.
- The array comprises internal protuberances in contact with the second fluid.
- The matrix has a stack of layers; each fin being inclined relative to the layers.
- The material comprises an inlet and an outlet for the first fluid, the inlet and the outlet being connected by the walls, the matrix comprising in particular an outer shell in which are formed the inlet and outlet.
- The flow direction of the first fluid is defined by the direction from the inlet to the outlet.
- The matrix includes several arrays housed in the same channel.

The invention also relates to a heat exchanger matrix with heat exchange fins, remarkable in that it comprises a helical path formed between the fins, possibly several coaxial helical paths which are formed between the fins. Optionally the coaxial helical paths have the same pitch, and/or the same radius.

The invention also relates to a heat exchanger matrix between a first fluid and a second fluid, the matrix comprising: a channel for the flow of the first fluid in a main direction; an array extending in the channel and in which the second fluid flows; at least two successive fins in the main direction extending from the array; remarkable in that between the two successive fins, the matrix comprises a passage oriented transversely to the main direction of the first fluid; and/or said successive fins are joined to the same array portion in junctions transversely offset in the main direction.

The subject of the invention is also a heat exchanger matrix between a first fluid and a second fluid, in particular a heat exchanger matrix for a turbomachine, the matrix comprising: a passage for the flow of the first fluid according to a main direction; an array extending in the crossing and in which the second fluid flows; remarkable in that the array supports at least two successive crosses which are arranged in the first fluid and which are rotated relative to each other. Optionally, the successive crosses are formed of successive fins. Optionally, the successive crosses are rotated relative to each other by at least 5°, or 10° or 20°.

The invention also relates to a matrix for a heat exchanger comprising at least two passages for a second fluid between which is arranged a spacing that can be traversed by a first fluid moving in a main direction, the spacing being provided with at least two non-parallel fins each connecting the first passage to the second passage, characterized in that, viewed in a plane perpendicular to the main direction of flow of the first fluid, the fins intersect at one point of the spacing that is separate from the connection area of the fins to the passages.

The invention also relates to a turbomachine, in particular a turbojet comprising a heat exchanger with a matrix, bearings, and a transmission driving a fan, characterized in that the matrix is in accordance with the invention, preferably the heat exchanger is an oil air heat exchanger.

According to an advantageous embodiment of the invention, the turbomachine comprises a circuit with oil forming the second fluid, said oil being in particular a lubricating and/or cooling oil.

According to an advantageous embodiment of the invention, the turbomachine comprises an air extracting sleeve, said air forming the first fluid.

According to an advantageous embodiment of the invention, the bearings and/or the transmission are fed by the oil passing through the exchanger.

According to an advantageous embodiment of the invention, the heat exchanger has a generally arcuate shape; the tubes possibly being oriented radially.

The invention also relates to a method for producing a heat exchanger matrix between a first fluid and a second fluid, the matrix comprising: a channel for the flow of the first fluid; an array extending in the channel and in which the second fluid flows; the method comprising the steps of: (a) designing the heat exchanger with its matrix; (b) producing the matrix by additive manufacturing in a printing direction; remarkable in that the step (b) comprises the realization of fins extending in principal directions which are inclined relative to the printing direction, the matrix possibly being in accordance with the invention.

According to an advantageous embodiment of the invention, the fins are arranged in planes inclined with respect to the printing direction of an angle β between 20° and 60°, possibly between 30° and 50°.

According to an advantageous embodiment of the invention, step (b) comprises producing tubes inclined relative to the printing direction by an angle of between 20° and 60°, possibly between 30° and 50°.

According to an advantageous embodiment of the invention, step (b) comprises producing passages substantially parallel to the printing direction.

The subject of the invention is also an aircraft, in particular a jet airplane, comprising a turbomachine and/or a heat exchanger matrix, which is remarkable in that the matrix is in accordance with the invention, and/or the turbomachine is in conformity with the invention. to the invention, and/or the matrix is manufactured according to an embodiment of the invention.

According to an advantageous embodiment of the invention, the matrix is disposed in the turbomachine, and/or in the fuselage, and/or in a wing of the aircraft.

In general, the advantageous modes of each object of the invention are also applicable to the other objects of the invention. Insofar as possible, each object of the invention is combinable with other objects. The objects of the invention are also combinable with the embodiments of the description, which in addition are combinable with each other.

Advantages

The invention makes it possible to increase the exchange of heat while limiting the pressure drops of the air flow. In the context of a turbojet oil cooler, this solution becomes particularly relevant since the cold source is very low temperature in addition to being available in large quantities given the flow rate of the secondary flow. To not slow down the flow of fresh air as it passes through the matrix promotes its renewal and limits its rise in temperature. Thus, the fins and tubes downstream of the heat exchanger benefit from fresh air with an optimum temperature difference.

The inclination of the successive fins allows a better participation of the air in the heat exchange while limiting the necessary contact surface. This reduces the pressure losses, and generally the creation of entropy. Furthermore, the orientation of the passages between the fins increases the passage sections, but still reduces the pressure drops.

The links formed by the fins make it possible to connect the tubes or the parts of the mesh. Thus, they optimize the mechanical resistance. Since these links are inclined relative to each other, the overall stiffness is improved because some links support compression stresses while others support extension stresses.

DETAILED DESCRIPTION OF THE EMBODIMENTS

In the following description, the words "upstream" and "downstream" are in reference to the main flow direction of the flow in the exchanger.

Figure 1:
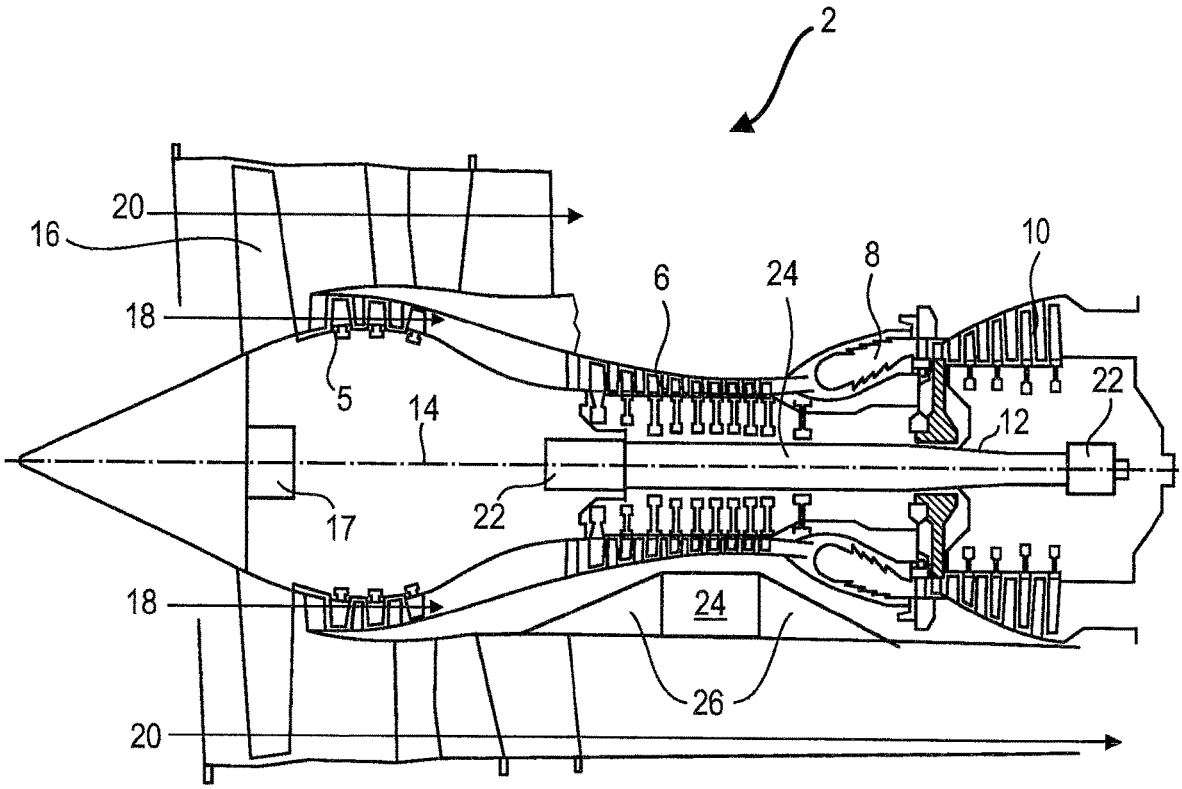
FIG. 1 represents an axial turbomachine according to the invention.

FIG. 1 is a simplified representation of an axial turbomachine. It is a double-flow turbojet engine. The turbojet engine 2 comprises a first compression stage, called a low-pressure compressor 5, a second compression stage, called a high-pressure compressor 6, a combustion chamber 8 and one or more stages of turbine 10. In operation, the mechanical power of the turbine 10 is transmitted via the central shaft to the rotor 12 which sets in motion the two compressors 5 and 6. The latter comprise several rows of rotor blades associated with rows of stator vanes. The rotation of the rotor 12 about its axis of rotation 14 thus makes it possible to generate an air flow and to compress it progressively until it reaches the combustion chamber 8.

An inlet fan 16 is coupled to the rotor 12 via a transmission 17. It generates a flow of air which splits into a primary flow 18 passing through the various stages of the turbomachine mentioned above, and a secondary flow 20. The secondary flow can be accelerated to generate a thrust.

The transmission 17 and the bearings 22 of the rotor 12 are lubricated and cooled by an oil circuit. Its oil passes through a heat exchanger 24 placed in a sleeve 26 inside the secondary flow 20 used as a cold source.

Figure 2:
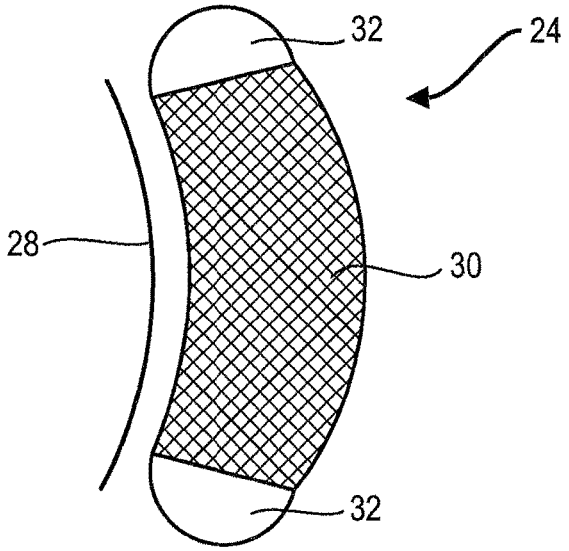
FIG. 2 outlines a front view of a heat exchanger according to the invention.
Figure 3:
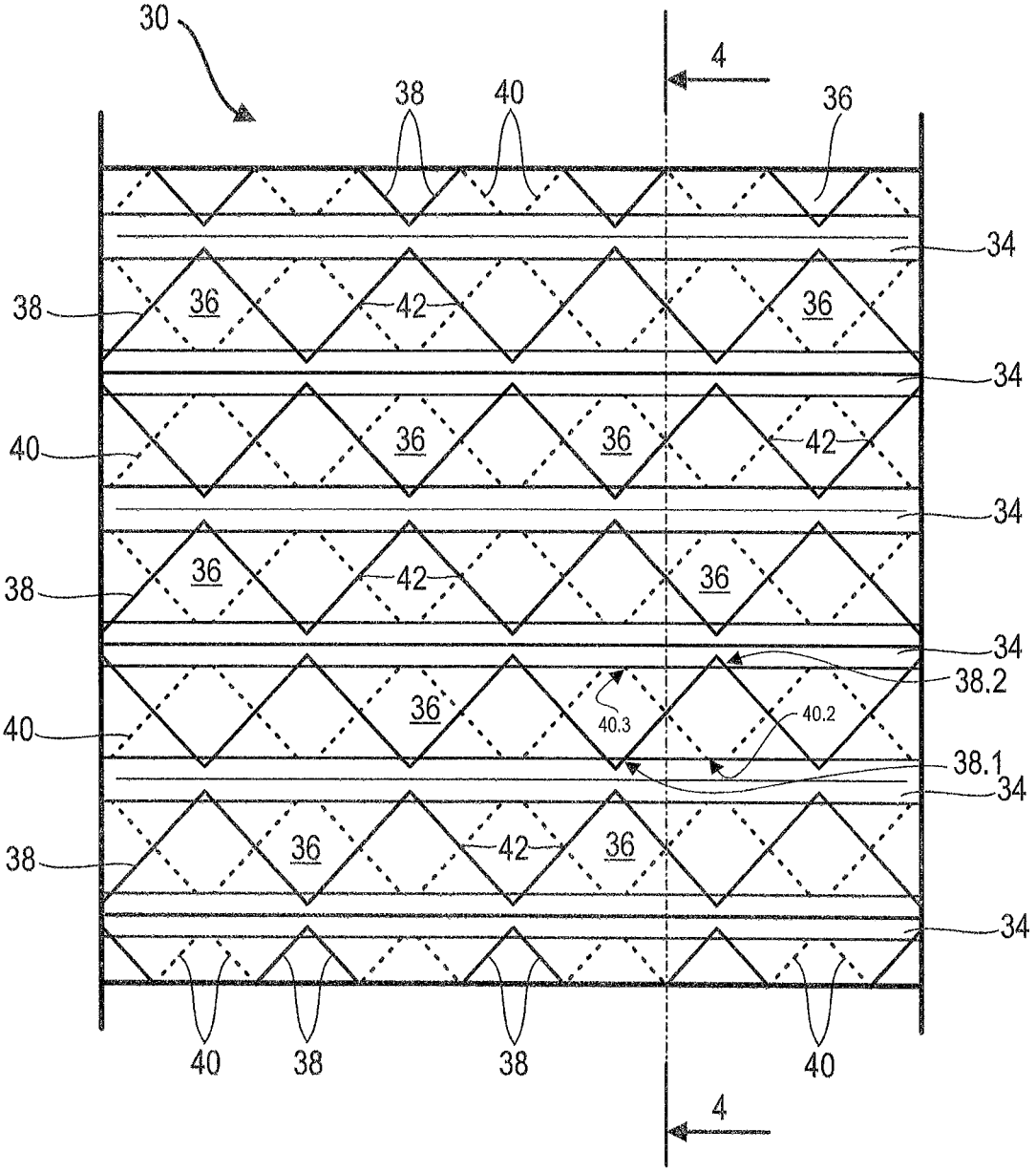
FIG. 3 illustrates a front view of a matrix of the heat exchanger according to a first embodiment of the invention.

FIG. 2 shows a plan view of a heat exchanger 24 such as that shown in FIG. 1. The heat exchanger 24 has a generally arcuate shape. It matches an annular housing 28 of the turbomachine. It is penetrated by the air of the secondary flow which forms a first fluid, and receives oil forming a second fluid. The heat exchanger comprises a matrix 30 arranged between two manifolds 32 closing its ends and collecting the second fluid; for example the oil, during its cooling. The exchanger may be hybrid and comprise both types of matrices described below. FIG. 3 outlines a front view of a heat exchanger matrix 30 according to the first embodiment of the invention. The matrix 30 may correspond to that represented in FIG. 2.

The matrix 30 has a channel allowing the first fluid to flow through the matrix 30. The flow can be oriented in a main direction, possibly perpendicular to the two opposite main faces. The channel can usually form a (set) of corridor(s); possibly of variable external contour. In order to allow the exchange of heat, an array receiving the second fluid is arranged in the matrix. The array may comprise a series of tubes 34. The different tubes 34 may provide corridors 36 between them. In order to increase the heat exchange, the tubes 34 support fins (38; 40). These fins (38; 40) can be placed one after the other according to the flow of the first fluid, so that they form successive fins according to this flow. The number of fins in the matrix 30 may vary. In the present matrix 30, there is shown a first succession with front fins 38 (shown in solid lines), and rear fins 40 (shown in dashed lines). The front fins 38 are placed in a front plane, and the rear fins 40 are placed in the background.

The fins (38; 40) are offset from one plane to another. Offset means a variation of inclination, and/or a difference transversely to the flow of the first fluid. For example, two successive fins (38; 40) can each extend in the first fluid in a respective fin direction. These fin directions can be inclined relative to each other, in particular inclined by 90°. From the front, the successive fins (38; 40) build crosses, for example series of crosses connecting the tubes 34. Since the fins (38; 40) are inclined relative to the tubes 34, they form triangles, or legs strengthening the matrix. Each of the fins (38; 40) has two respective ends 38.1, 38.2, 40.2, 40.3 which connect to the tubes 34.

The intersections 42 in the space of the successive fins (38; 40) is away from the tubes 34, possibly midway between two successive tubes 34. This central position of the intersections 42 avoids amplifying the losses of air pressure in the boundary layers.

Figure 4:
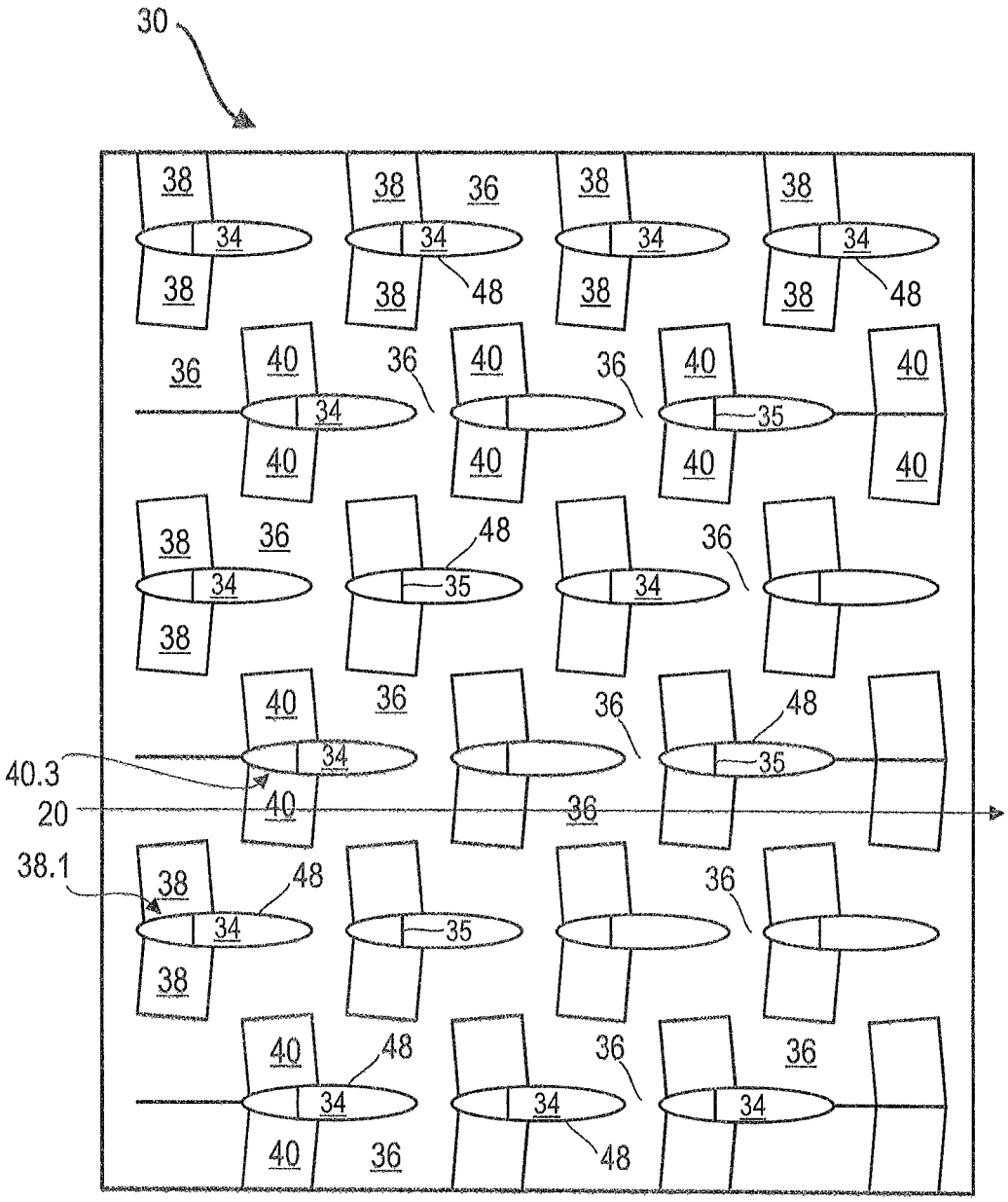
FIG. 4 is a section of the matrix along the axis 4-4 plotted in FIG. 3.

FIG. 4 is sectional along the axis 4-4 drawn in FIG. 3. Seen in section from intersections, the fins (38; 40) are visible in halves.

Several successions of fins (38; 40) are shown one behind the other along the primary flow 20. The fins (38; 40) extend from the walls 48 forming the tubes 34. They can form flat tongues. As is apparent here, the tubes 34 are staggered in the section. They form in particular horizontal lines, aligned along the secondary flow 20, or aligned according to the flow of the first fluid.

The matrix 30 has an inlet 41 and an outlet 43 for the first fluid. The primary flow 20 passes the matrix 30 from the inlet 41 to the outlet 43, thus defining the direction of flow of the first fluid, the main direction of flow. The matrix 30 may comprise an outer shell 45. The outer shell may form an outer skin of the matrix 30. The outer shell 45 may define, in particular surround the channel and/or the array. The inlet 41 and the outlet 43 may be made in the outer shell 45. The latter may form a mechanical support for the entities of the matrix.

The walls 48 of the tubes 34 form the structure of the matrix 30, the heat exchange taking place at the cross-section of their thicknesses. In addition, the tubes 34 can be partitioned by an inner partition 35, which increases the rigidity of these tubes 34. Optionally, the inside of the tubes is provided with obstacles (not shown) to generate turbulence in the second fluid in order to increase the exchange of heat.

The fins (38; 40) of the different planes of fins can be remote from the other fins, which reduces the mass and the occupation of the channel. The front fins 38 can join the upstream tubes, and the rear fins 40 join the tubes arranged downstream. This configuration makes it possible to connect the tubes 34 to each other despite the presence of the corridors 36 separating them.

The tubes 34 may have rounded profiles, for example in ellipses. They are thinned transversely to the flow of the first fluid to reduce the pressure losses, and thus increase the flow. The tubes 34 placed in the extension of each other according to the flow of the first fluid are separated by the corridors 36. Similarly, other corridors 36 separate the superimposed tubes. Since these corridors 36 communicate with each other, the matrix becomes open and the flow of the first fluid can flow in a straight line as well as diagonally with respect to the secondary flow 20.

Figure 5:
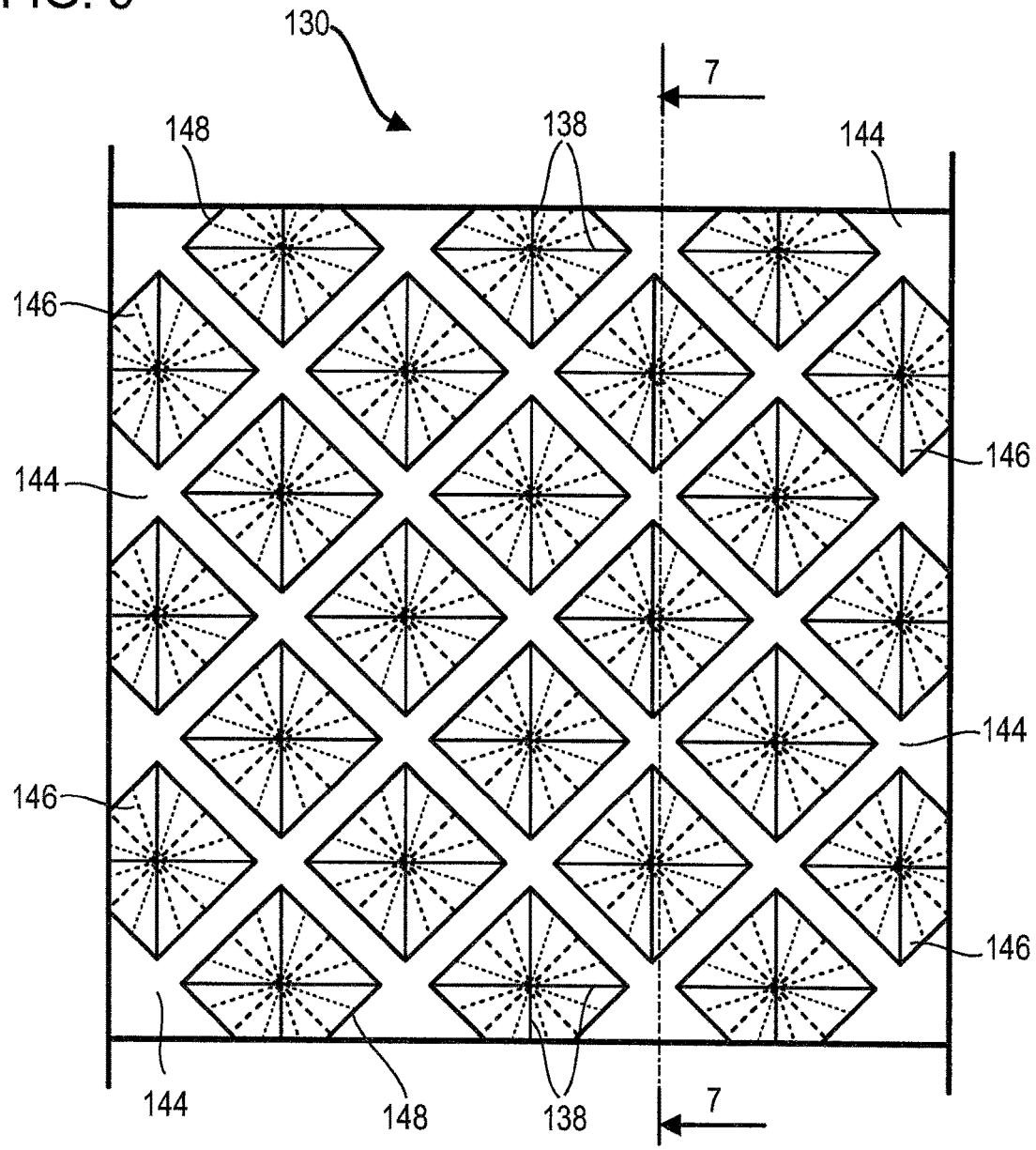
FIG. 5 illustrates a front view of a heat exchanger matrix according to a second embodiment of the invention.

FIG. 5 represents a matrix 130 of heat exchanger according to a second embodiment of the invention. This FIG. 6 repeats the numbering of the preceding figures for identical or similar elements, however, the numbering is incremented by 100. Specific numbers are used for the elements specific to this embodiment. The matrix 130 is shown in the front view such that the flow of the first fluid meets when it enters the channel. The array forms a mesh 144, for example with paths connected to each other forming polygons. The mesh 144 may optionally form squares. The meshes of the mesh 144 may surround corridors 146 in which the first fluid flows. These corridors 146 may be separated from each other by the mesh 144. The array comprises a wall 148 which marks the separation between the first and the second fluid. The heat exchange is happening through this partition 148. It also forms the structure of the matrix 130. Inside, the corridors 146 are barred by successive fins (138; 140), preferably by several series of successive fins.

Figure 6:
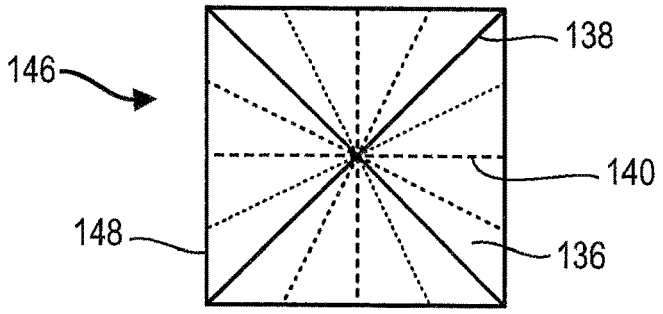
FIG. 6 shows an enlargement of a typical channel of FIG. 5.

FIG. 6 shows an enlargement of a corridor 146 representative of those shown in FIG. 5.

The fins (138; 140) are located on the wall 148. They can connect the opposite faces. The fins (138; 140) can form crosses, for example by joining two coplanar and secant fins. In addition, the set of fins (138; 140) can form a succession of successive crosses. The different crosses are rotated relative to each other in order to optimize the heat exchange while limiting the losses of loads. For example, each cross is rotated 22.5 degrees from its upstream cross. A pattern with four crosses rotated regularly can be repeated. Optionally, the crosses form helical paths 136 within the corridors 146, for example four helical paths 136 wound around each other. The corridors 146 may be straight or twisted.

Figure 7:
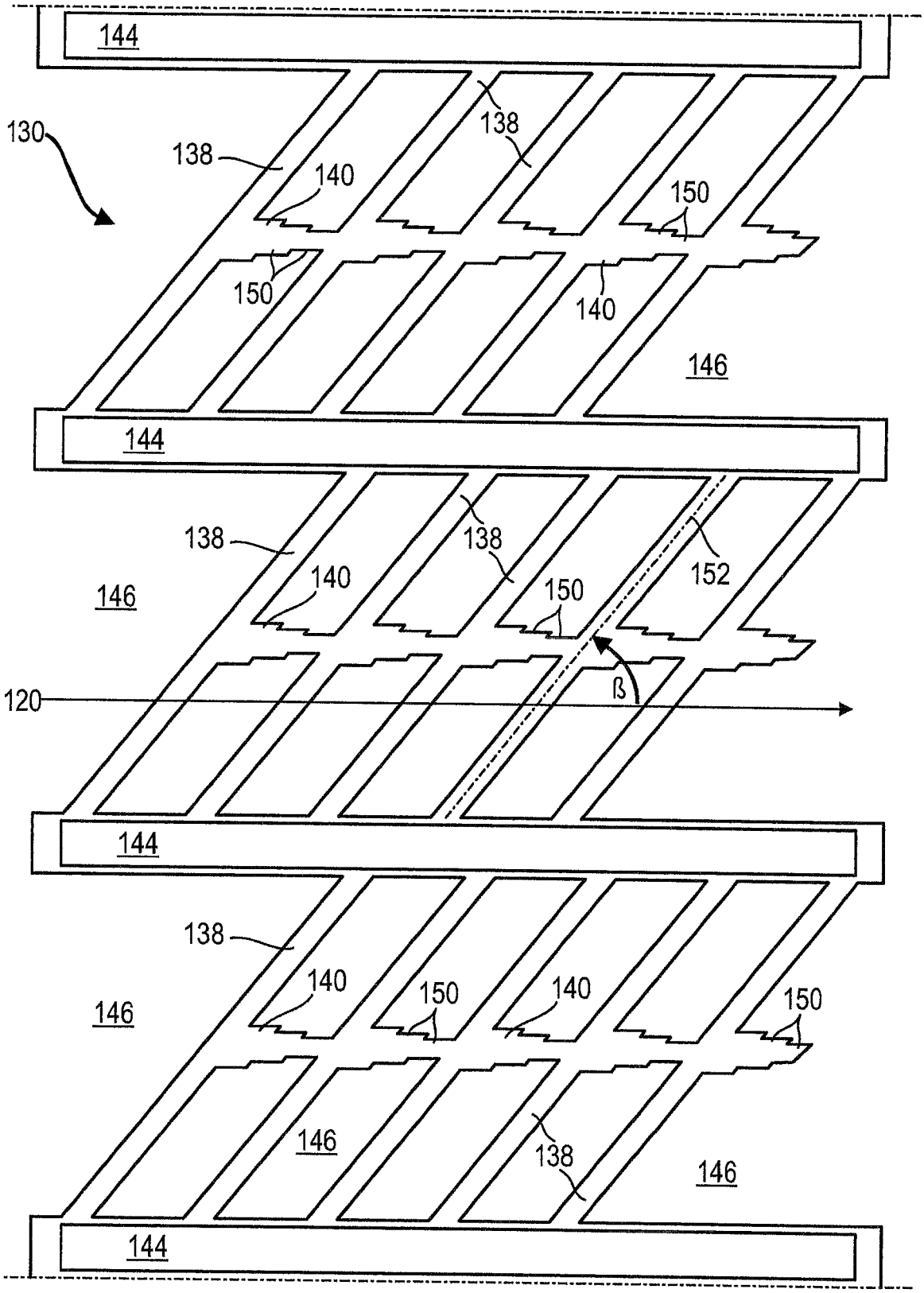
FIG. 7 is a section of the matrix of the second embodiment along the axis 7-7 plotted in FIG. 5.

FIG. 7 is a partial cross-section along the axis 7-7 plotted in FIG. 5. Three corridors 146 are shown, as four mesh portions 144 in which the second fluid flows; for example, oil.

The fins (138; 140) and thus the crosses they form appear in cross-section. The front fins 138 are visible in all their lengths while the rear wings 140 are only partially visible since they remain in section. The following crosses are also partially represented via their hubs 150 of crossing their fins.

The crosses are formed in planes. These planes are parallel to each other, and inclined relative to the secondary flow 120; is inclined with respect to the flow of the first fluid. The inclination angle β of the planes 152 of the fins and the main direction of the first fluid can be between 30° and 60°. The angle of inclination p may be 45°. It follows that the corridors 146 comprise sections inclined with respect to the main direction of the flow of the first fluid through the matrix 130. This arrangement causes the first fluid to change its speed as it circulates, and better cool the offset fins.

Figure 8:
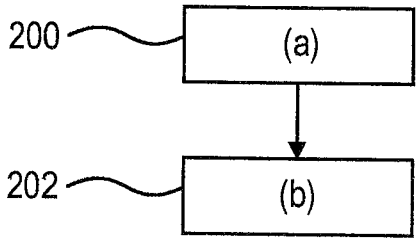
FIG. 8 is a diagram of the process for producing a heat exchanger matrix according to the invention.

FIG. 8 represents a diagram of a method for producing a heat exchanger matrix. The matrix produced may correspond to those described with reference to FIGS. 2 to 7.

The method may comprise the following steps, possibly carried out in the following order:

(a) 200 design of the matrix of the exchanger, the matrix comprising a one-piece body with successive fins;

(b) making the matrix 202 by additive manufacturing in a printing direction that is inclined relative to the fin directions of the fins or inclined relative to each fin. This inclination can be between 30 and 50°.

The printing direction may be inclined relative to the tubes at an angle between 30° and 50°. The printing direction may be substantially parallel to the corridors, or inclined at less than 10°, or less than 4°.

The additive manufacturing process can be made with powder, optionally titanium or aluminum powder. The thickness of the layers can be between 20 microns and 50 microns, which makes it possible to achieve a fin thickness of about of 0.35 mm, and partitions of 0.60 mm.

The manifolds can be made of mechanically welded sheets, and then welded to the ends of the matrix to form a manifold.

Being made by additive layers manufacturing, in particular powder-based, the material of the matrix can show a stack of layers. These layers can be parallel. The layers can show crystallographic variations at their interfaces.

Advantageously, each fin is inclined relative to the layers, in particular to the layers forming it.

Figure 9:
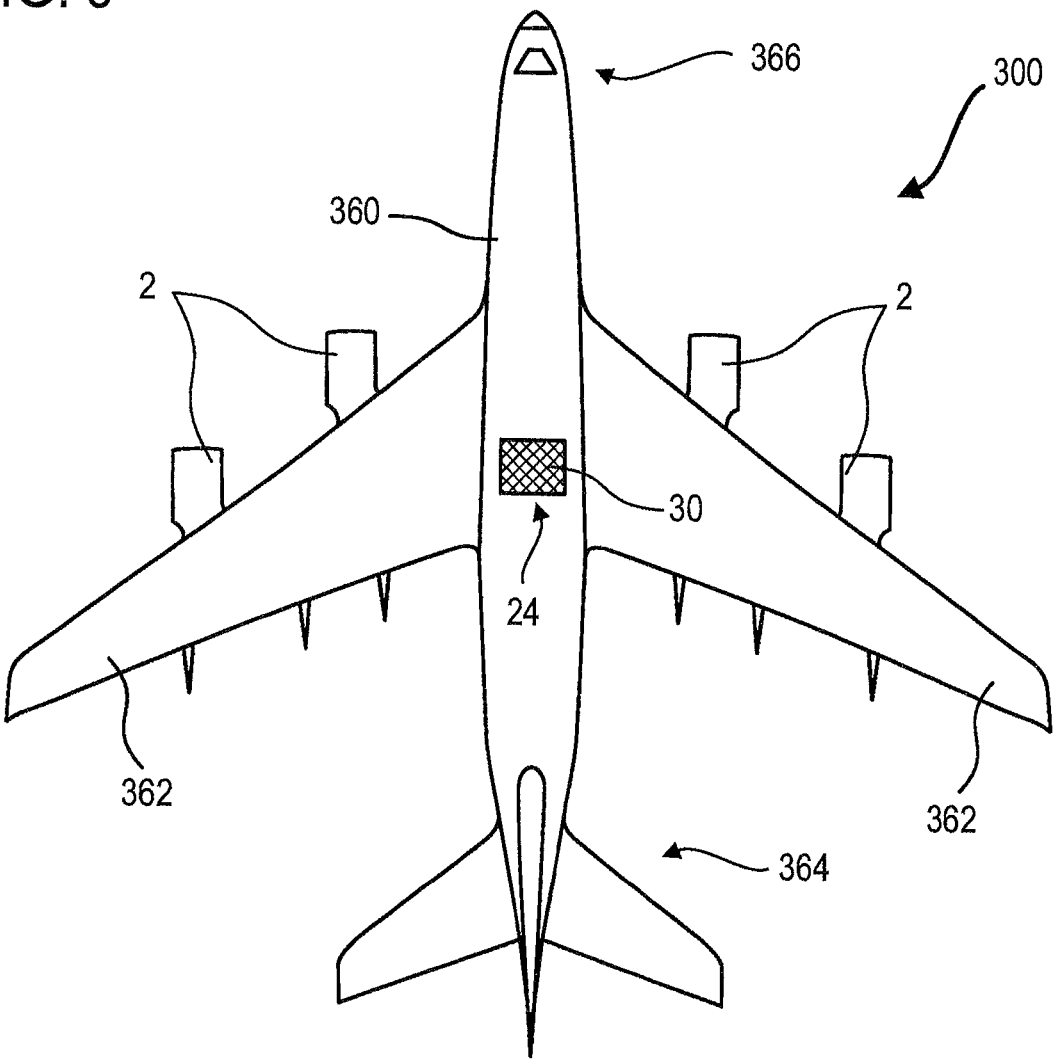
FIG. 9 represents an aircraft according to the invention.

FIG. 9 shows an aircraft 300 seen from above. It can be a jet plane.

The aircraft 300 may have a fuselage 360, defining in particular the main body. It may comprise two lateral wings 362, in particular connected by the fuselage 360. The lateral wings 362 may be arranged between the cockpit 366 and the tail 364 of the aircraft 300.

Each of the lateral wings 362 can receive one or more turbomachines 2, in particular turbojet engines, making it possible to propel the aircraft 300 in order to generate a lift phenomenon in combination with the lateral wings 362. At least one or each or several turbomachines 2 can be identical or similar to that presented in relation with FIG. 1.

The aircraft 300 comprises at least one matrix, in particular a heat exchanger matrix 24. For example, one or more heat exchanger matrices 24 may be accommodated in the fuselage 360 or alternatively, one or more heat exchanger matrices 24 may/may be accommodated in one or more lateral wings 362, and/or in one or more or in each turbomachine 2.

At least one, or more, or each heat exchanger matrix may be the same or similar to one or more of FIGS. 2 to 7, for example according to the first or second embodiment of the invention.

The invention claimed is:

1. Matrix for a heat exchanger of a turbojet engine, the matrix comprising:

a channel for a first fluid, the channel defining a main direction along which the first fluid flows;

an array of tubes defining passages for a second fluid, the tubes extending in the channel, the array of tubes comprising three tubes arranged in a staggered manner, each tube of the three tubes being parallel to each other tube of the three tubes, the three tubes being constituted by a first tube, a second tube and a third tube;

wherein the three tubes support at least two fins arranged one behind the other in the main direction;

wherein the at least two fins are planar, extend in parallel with the main direction and are inclined relative to one another;

wherein each fin of the at least two fins has a first end and a second end;

wherein the first end of a first fin of the at least two fins is connected to the first tube, the first end of a second fin of the at least two fins is connected to the third tube; and wherein the second end of the first fin and the second end of the second fin are connected to the second tube.

2. Matrix according to claim 1, wherein the at least two fins are inclined relative to each other of an angle of around 90° C.

3. Matrix according to claim 1, wherein the at least two fins, seen in the main direction define crosses.

4. Matrix according to claim 1, wherein seen in a plane that is perpendicular to the main direction, the at least two fins cross each other at away from the tubes.

* * * * *